US010400707B2

(12) United States Patent
Wang et al.

(10) Patent No.: US 10,400,707 B2
(45) Date of Patent: Sep. 3, 2019

(54) METHOD AND SYSTEM FOR PROCESSING AN AUTOMOTIVE ENGINE BLOCK

(71) Applicant: GM GLOBAL TECHNOLOGY OPERATIONS LLC, Detroit, MI (US)

(72) Inventors: Qigui Wang, Rochester Hills, MI (US); Marie-christine Jones, Bingham Farms, MI (US); Yucong Wang, West Bloomfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/660,154

(22) Filed: Jul. 26, 2017

(65) Prior Publication Data

US 2019/0032594 A1 Jan. 31, 2019

(51) Int. Cl.

| | |
|---|---|
| ***F02F 1/00*** | (2006.01) |
| ***C22F 1/00*** | (2006.01) |
| ***C22F 1/04*** | (2006.01) |
| ***C22F 1/06*** | (2006.01) |
| ***C21D 1/18*** | (2006.01) |
| ***C21D 5/00*** | (2006.01) |
| *F02F 7/00* | (2006.01) |

(52) U.S. Cl.

CPC ..... *F02F 1/004* (2013.01); *C21D 1/18* (2013.01); *C21D 5/00* (2013.01); *C22F 1/002* (2013.01); *C22F 1/04* (2013.01); *C22F 1/06* (2013.01); *F02F 7/0085* (2013.01); *F02F 2001/008* (2013.01); *F02F 2200/06* (2013.01); *F05C 2251/046* (2013.01)

(58) Field of Classification Search

CPC ..... F02F 1/004; F02F 1/12; F02F 1/20; F02F 2007/009; F02F 7/0087; B22D 19/0009; B22D 19/0081; F16J 10/04

See application file for complete search history.

(56) References Cited

U.S. PATENT DOCUMENTS

| | | | | |
|---|---|---|---|---|
| 5,183,025 | A * | 2/1993 | Jorstad | F02F 1/004 123/193.2 |
| 5,333,668 | A * | 8/1994 | Jorstad | B22D 19/0009 164/100 |
| 5,429,173 | A * | 7/1995 | Wang | B22D 19/08 164/100 |
| 5,755,028 | A * | 5/1998 | Takami | B22D 19/0009 29/888.06 |
| 7,191,770 | B1 * | 3/2007 | Anderson | F02F 1/004 123/193.2 |
| 9,017,823 | B2 * | 4/2015 | Liu | C23C 30/00 123/193.1 |
| 2004/0065290 | A1 * | 4/2004 | Wakade | F02F 1/004 123/193.2 |
| 2004/0226402 | A1 * | 11/2004 | Fuchs | C25D 5/02 74/828 |

(Continued)

*Primary Examiner* — Long T Tran

(57) ABSTRACT

A method and system for processing an engine block that includes a cylinder liner. The engine block having a first material with different coefficient of thermal expansion than a second material forming the cylinder liner. The method includes providing an insulating barrier to the cylinder liner, and quenching the engine block. The insulating barrier provides a lower cooling rate to the second material forming the cylinder liner than a cooling rate for the first material forming the engine block during the quenching.

14 Claims, 3 Drawing Sheets

(56) References Cited

U.S. PATENT DOCUMENTS

| | | | | |
|---|---|---|---|---|
| 2004/0265163 | A1* | 12/2004 | Doty | C22C 21/04 420/548 |
| 2007/0012176 | A1* | 1/2007 | Takami | B22D 19/0009 92/171.1 |
| 2008/0245320 | A1* | 10/2008 | Ishikawa | F02F 1/10 123/41.74 |
| 2009/0260774 | A1* | 10/2009 | Shin | B22D 15/02 164/132 |
| 2010/0326619 | A1* | 12/2010 | Kim | B21J 5/00 164/460 |
| 2015/0218687 | A1* | 8/2015 | Goedel | C23C 4/02 29/888.061 |
| 2017/0175668 | A1* | 6/2017 | Schepak | C23C 4/14 |

* cited by examiner

METHOD AND SYSTEM FOR PROCESSING AN AUTOMOTIVE ENGINE BLOCK

FIELD

The present disclosure relates to a method and system for processing an automotive engine block.

INTRODUCTION

This introduction generally presents the context of the disclosure. Work of the presently named inventors, to the extent it is described in this introduction, as well as aspects of the description that may not otherwise qualify as prior art at the time of filing, are neither expressly nor impliedly admitted as prior art against this disclosure.

Cylinder liners for combustion engines made from, for example, cast iron, provide improved wear resistance in engine blocks that may be formed from lightweight materials, such as, for example, an aluminum alloy. These cylinder liners may be placed within an engine block mold and the engine block material may be cast around the cylinder liners. The cylinder liners are then embedded within and define cylinder bores within the engine block. These liners are known as a "cast in place" type of liner. Other methods and system also exist for providing cylinder liners into an automotive engine block.

The engine blocks which include the cast-in-place cylinder liners may undergo a quenching operation in which the engine block is quenched with a quenching liquid, such as, for example, water. Quenching rapidly cools the component being treated. Quenching itself is a type of heat treatment process that may prevent undesired low temperature processes, such as, for example, undesirable phase transformations from occurring.

A problem that may result from the quenching of an engine block which includes a cylinder liner that is made from a different material than that of the engine block is that the dissimilar materials may have different coefficients of thermal expansion which, when simultaneously cooled together during a quenching process, for example, may result in undesirable residual stresses. An exemplary embodiment of an engine block may include an aluminum alloy for the block material and an iron alloy for the cylinder liner material. In general, aluminum alloys have a higher coefficient of thermal expansion than iron alloys. Thus, when an aluminum alloy engine block and iron alloy cylinder liner are cooled together during a quenching process, the aluminum alloy will try to contract more than the iron alloy liner. This contraction of the aluminum alloy block is resisted by the iron liner which may then result in undesirable and relatively high residual tensile stress in the aluminum alloy block. The high residual tensile stress in the aluminum engine block material may lead to the development of cracks in the engine block and/or other failures. This problem may be further compounded as the power density of cylinders within the engine block is increased which may tend to reduce the amount of engine block material between the cylinder liners, which may leave the aluminum engine block even more susceptible to failure.

Additionally, a high residual tensile stress in the block material may also lead to the distortion of the cast iron liner after it is machined to a final dimension. A distorted liner may not only lead to increased oil consumption but may also degrade the engine performance. Further, a high residual tensile stress may result in a crack and/or other failure of the liner during engine operation.

SUMMARY

In an exemplary aspect, a method and system for processing an engine block that includes a cylinder liner. The engine block having a first material with a different coefficient of thermal expansion than a second material forming the cylinder liner. The method includes providing an insulating barrier to the cylinder liner, and quenching the engine block. The insulating barrier provides a lower cooling rate to the second material forming the cylinder liner than a cooling rate for the first material forming the engine block during the quenching.

In another exemplary aspect, providing the insulating barrier includes providing an insulating coating on an internal surface of the cylinder liner.

In another exemplary aspect, the insulating barrier includes a polymer material.

In another exemplary aspect, the insulating barrier includes a ceramic material.

In another exemplary aspect, providing the insulating barrier includes positioning a cover adjacent an end portion of the cylinder liner.

In another exemplary aspect, the cover prevents intrusion of a quenching medium into the enclosed volume.

In another exemplary aspect, the insulating barrier reduces contact between a quenching medium and the cylinder liner.

In another exemplary aspect, the method further includes further cooling the cylinder liner to relieve a residual tensile stress in the engine block material surrounding the cylinder liner.

In another exemplary aspect, the first material includes an Aluminum alloy.

In another exemplary aspect, the first material includes a Magnesium alloy.

In another exemplary aspect, the second material includes a cast Iron alloy.

In this manner, the insulating barrier reduces the cooling rate of the cylinder liner in comparison to the engine block which enables a significant reduction in residual tensile stress in the engine block material surrounding the cylinder liner. Further, preventing contact between a quenching liquid and the liner decreases the potential for thermal shock and may prevent or reduce the possibility for cracking during a quench.

Further areas of applicability of the present disclosure will become apparent from the detailed description provided below. It should be understood that the detailed description and specific examples are intended for purposes of illustration only and are not intended to limit the scope of the disclosure.

The above features and advantages, and other features and advantages, of the present invention are readily apparent from the detailed description, including the claims, and exemplary embodiments when taken in connection with the accompanying drawings.

BRIEF DESCRIPTION OF THE DRAWINGS

The present disclosure will become more fully understood from the detailed description and the accompanying drawings, wherein.

DETAILED DESCRIPTION

Figure 1:
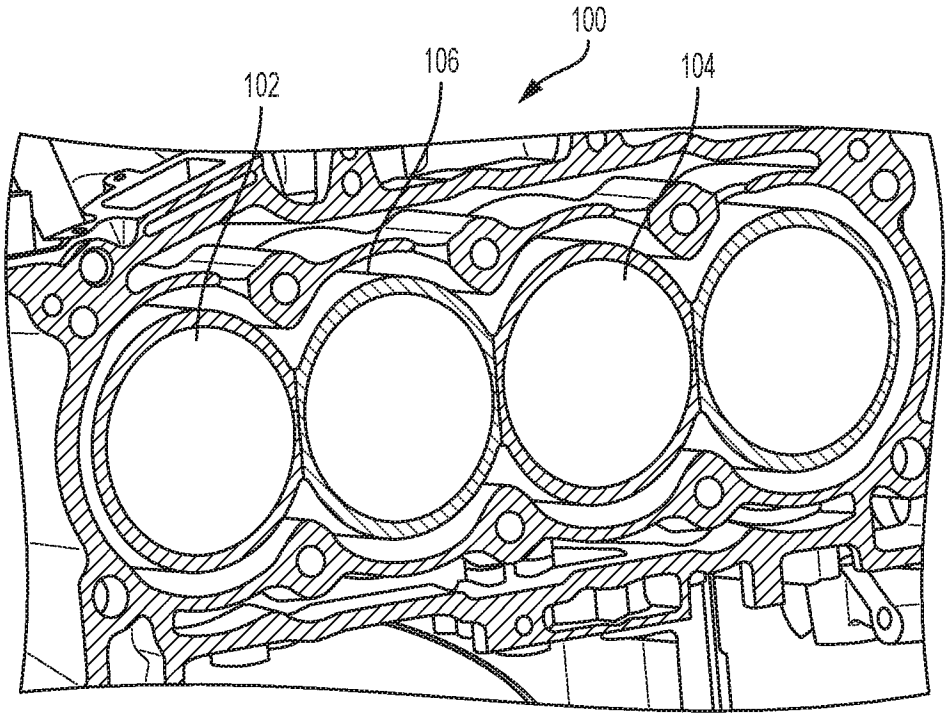
FIG. 1 is an isometric perspective view of an exemplary open deck engine block 100.

FIG. 1 illustrates an isometric perspective view of an open deck engine block 100. The engine block 100 includes a plurality of cylinder bores 102 that are defined by cylinder liners 104 which have been integrated into the engine block 100 during, for example, a casting process. In a cast in place process, these cylinder liners 104 may be positioned into a mold and the molten engine block material, such as, for example, an aluminum alloy, may then be injected into the mold. The molten material then surrounds the cylinder liners as it fills the mold. The material cools to a solid and the liners are firmly bonded to the engine block material. In an exemplary process, the casting process may inject the molten engine block material under a high pressure to ensure intimate contact between the engine block material and the cylinder liner.

Figure 2:
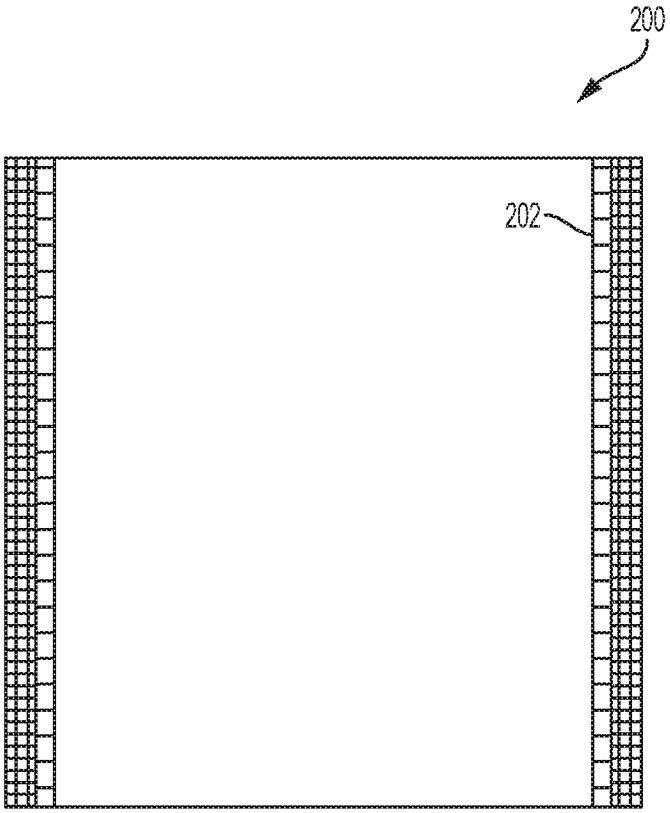
FIG. 2 is a cross-sectional elevation view of a cylinder liner with an insulating barrier in accordance with an exemplary embodiment of the present disclosure.

FIG. 2 is cross-sectional elevation view of a cylinder liner 200 with an insulating barrier 202 in accordance with an exemplary embodiment of the present disclosure. The insulating barrier 202 is a coating made from an insulating material that is applied to the inside diameter of the cylinder liner 200 The insulating barrier 202 reduces the rate of heat transfer from the internal surface of the cylinder liner 200. The insulating barrier 202 may be formed from any material which operates to reduce the rate of heat transfer during a quenching process. Preferably, the insulating barrier material is selected such that the material maintains the insulative properties during a quenching process.

The insulating barrier 202 may be formed from a high temperature resistant polymer such as, for example, a polyimide, a polyamideimide, a polyetherimide, and a polyetheretherketone, without limitation. In general, a quenching process only takes a short amount of time, therefore, the material forming the insulating barrier only needs to be able to maintain the insulative properties for short amount of time, for example, about five minutes. Further, the material forming the insulating barrier should maintain the insulative properties while being exposed to the relatively high temperatures of the heat treatment process, in particular, just before and during the quenching process.

Selection of a polymer material which may be useful as an insulating barrier may be made with reference to short term temperature exposure such as thermogravimetric analysis, data regarding the weight retention of a polymer as a function of time at specifically identified temperatures or as a function of increasing temperature at a given heating rate. Often, long term aging type data may have been collected for long term exposure to the temperatures, in some cases exceeding thousands of hours. In contrast, the insulating barrier need only maintain insulating characteristics for a comparatively much shorter amount of time which may approximate the amount of time for a high pressure die casting process and/or quenching process. Shorter term aging data may provide guidance in selecting an appropriate material for use as an insulating barrier. Those polymers which have a low weight loss or evaporation rate as indicated by that short term data, may be useful for the process and system of the present disclosure. The above identified polymers generally do not have a significant weight loss at the higher temperatures which may be relevant for engine block heat treatment processes.

The material forming the insulating barrier may also include a ceramic material such as, for example, Magnesia, Silica, Kaolin, Montmorillonite, Titanium Oxide, Calcium Oxide, Chromium Oxide, Alumina and the like without limitation. The material may be applied, for example, with particle sizes ranging from about two to about fifty microns in a solution. The solution may include, for example, a sodium silicate without limitation. Silica may act as a structural component which has chemical compatibility with other ceramic components. Further, Silica may also resist shrinkage and crazing. Magnesia may also act as a structural component and may have a coefficient of thermal expansion which approximates a cast iron material which may form the cylinder liner. A combination of Silica, Magnesia, and Alumina may further exhibit excellent thermal shock and thermal fatigue properties. A deflocculant and/or coagulant may also be provided as a portion of the material forming the insulating barrier. Kaolin and montmorillonite may serve as colloidal-type clay binders which may be adsorbed and bridge between ceramic particles. These materials may increase the green strength, the wetting of the particles, improve the viscosity, and improve the setting rate of the particles. The silicate solution may form chain units that connect ceramic particles together and may include silica which is suspended with small colloidal particles between about one to two nanometers in diameter. A reaction of colloidal silica with magnesia may form a magnesium silicate at the particle interfaces which provide a reaction bond. Alumina may react with colloidal silica to form aluminum silicate at the interfaces. The curing process for the ceramic material of the insulating barrier may promote these reactions.

Figure 3:
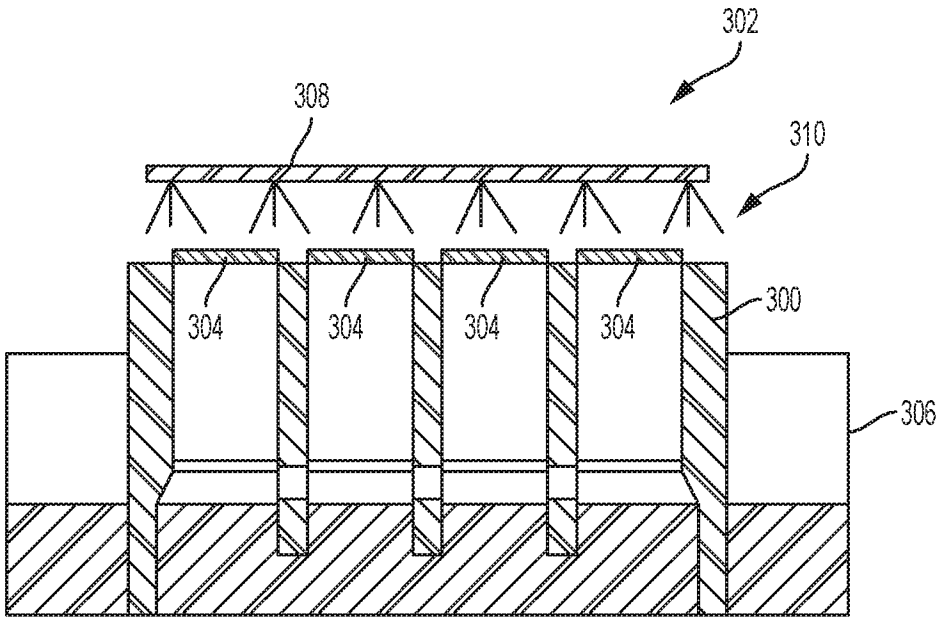
FIG. 3 is a schematic illustration of an engine block, including cylinder liners, undergoing a quenching operation with an insulating barrier in accordance with another exemplary embodiment of the present disclosure.

FIG. 3 is a schematic illustration of an engine block 300, including cylinder liners, undergoing a quenching operation 302 with an insulating barrier 304 in accordance with an exemplary embodiment of the present disclosure. In the quenching operation 302, the engine block 300 is positioned in a water tank 306 which captures water that is applied to the engine block 300 during the quenching operation 302. A quenching system 308 provides a supply of quenching liquid 310, such as, for example, water, which may be sprayed onto the engine block 300 to quench the engine block 300. In the exemplary embodiment illustrated in FIG. 3, an insulating barrier is provided by a set of covers or caps 304 which operate to resist exposing the cylinder liners to the quenching medium. The covers 304 may be attached to the engine block 300 and/or provided in a fixture (not shown) which may be specifically adapted to provide the insulating barrier during the quenching operation. The covers 304 may be formed from, for example, a metal shield or a temperature-resistant rubber plug, without limitation, which encloses the internal volume of the cylinder liners with air. In this manner, the rate at which heat is removed from the cylinder liners is reduced in comparison to the engine block material that surrounds the cylinder liners.

In an alternative, non-limiting embodiment, the quenching process illustrated by FIG. 3 may be modified by adding and/or substituting the insulating barrier 202 that is described with reference to FIG. 2 above. The insulating barrier 202 similarly serves to resist exposure of the cylinder liner to the quenching liquid which reduces the rate of cooling of the cylinder liner in comparison to the engine block material surrounding the cylinder liner(s).

As explained above, the material forming the engine block may be different than the material forming the cylinder liner. These different materials may have differing coefficients of thermal expansion, which means the materials will shrink at different rates during cooling. In an exemplary embodiment, an aluminum alloy may form the engine block and an iron alloy may form the cylinder liner. Aluminum alloys tend to have higher coefficients of thermal expansion than those of iron alloys. Therefore, an aluminum alloy of an engine block will try to shrink more than an iron alloy in a cylinder liner when the two are cooled substantially at the same rate which would occur in the absence of an insulating barrier for the cylinder liner. Thus, the iron cylinder liner resists the shrinkage of the aluminum material surrounding the liner in the engine block which results in a residual stress in the engine block.

Reducing the rate of heat transfer from the cylinder liner during a quenching operation serves to maintain the cylinder liner at a higher temperature than the surrounding aluminum alloy engine block material and at a higher temperature that would have resulted in the absence of the insulating barrier. This may temporarily result in an increased residual tensile stress in the aluminum engine block material above that of an engine block which did not include an insulating barrier at the end of the quenching operation. In the absence of the insulating barrier, quenching of the engine block may result in a residual tensile stress in the aluminum material surrounding the cylinder liner to be about 100 Megapascal. In contrast, the insulating barrier of the present disclosure may result in a temporary residual tensile stress in the aluminum material to be about 120 Megapascal. However, the difference is that in the absence of the insulating barrier, the temperature of the cylinder liner and surrounding engine block material is substantially the same immediately post quench. In contrast, the insulating barrier results in the cylinder liner having a higher temperature than the surrounding engine block material immediately post quench. The subsequent further cooling of the cylinder liner tends to relieve the residual tensile stress in the surrounding aluminum alloy engine block material. After the further cooling of the liners has completed, the residual tensile stress of the aluminum is lower when the insulating barrier is provided. For example, after the cylinder liner has further cooled the residual tensile stress in the aluminum engine block may be reduced to between about 50-80 Megapascals, which is significantly lower than the about 100 Megapascals in those engine blocks which did not use the inventive insulating barrier of the present disclosure. Additionally, the higher temperature of the cylinder liner which resulted from the insulating barrier also tends to maintain the temperature of the aluminum engine block material immediately adjacent to the cylinder liner at a higher temperature which means that the aluminum engine block material is softer and may more easily deform in response to the delayed shrinkage of the cylinder liner which also means a further reduction in residual tensile stress in the aluminum engine block. In an exemplary embodiment, the residual tensile stress is elastically removed from the engine block material.

In another exemplary embodiment, the insulating barrier may also be maintained during further subsequent processing such as, for example, an aging process. During the aging, the cylinder liners may continue to cool and the insulating barrier may reduce the rate at which the cylinder liner cools during the aging process which may further improve and/or reduce the residual tensile stress that remains in the engine block after processing.

In general, the insulating barrier enables the engine block material to cool down faster than the cylinder liner which, while it may result in temporary residual tensile stress being higher immediately post quench, after further cooling of the cylinder liner that residual tensile stress is lower than that which results in the absence of an insulating barrier.

This description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A method for processing an engine block that includes a cylinder liner, the engine block having a first material with different coefficient of thermal expansion than a second material forming the cylinder liner, the method comprising:

providing the engine block in which the cylinder liner has been cast;

providing an insulating barrier to the cylinder liner on a surface of the cylinder liner that faces away from the first material of the engine block, after providing the engine block in which the cylinder liner has been cast; and quenching the engine block, wherein the insulating barrier provides a lower cooling rate to the second material forming the cylinder liner than a cooling rate for the first material forming the engine block during the quenching, wherein providing the insulating barrier comprises providing an insulating coating on an inner cylindrical surface of the cylinder liner.

2. The method of claim 1, wherein the insulating barrier comprises a polymer material.

3. The method of claim 1, wherein the insulating barrier comprises a ceramic material.

4. The method of claim 1, wherein the insulating barrier reduces contact between a quenching medium and the cylinder liner.

5. The method of claim 1, further comprising further cooling the cylinder liner to relieve a residual tensile stress in the engine block material surrounding the cylinder liner.

6. The method of claim 1, wherein the first material comprises an Aluminum alloy.

7. The method of claim 1, wherein the first material comprises a Magnesium alloy.

8. The method of claim 1, wherein the second material comprises a cast Iron alloy.

9. An engine block, the engine block comprising:

a first material forming the engine block having a first coefficient of thermal expansion;

a second material forming a cylinder liner cast within the first material of the engine block and having a second coefficient of thermal expansion that is lower than the first coefficient of thermal expansion; and an insulation barrier on a surface of the cylinder liner that faces away from the first material of the engine block that insulates the cylinder liner such that the second material of the cylinder liner has a lower cooling rate than the first material of the engine block that surrounds the cylinder liner, wherein the insulating barrier comprises an insulating coating on an inner cylindrical surface of the cylinder liner.

10. The engine block of claim 9, wherein the insulating barrier comprises a ceramic material.

11. The engine block of claim 9, wherein the insulating barrier comprises a polymer material.

12. The engine block of claim 9, wherein the insulating barrier is adapted to reduce contact between a quenching medium and the cylinder liner.

13. The engine block of claim 9, wherein the first material comprises an aluminum alloy.

14. The engine block of claim 9, wherein the second material comprises a cast iron alloy.

* * * * *